US011396811B2

(12) United States Patent
Lazzerini

(10) Patent No.: US 11,396,811 B2
(45) Date of Patent: Jul. 26, 2022

(54) VARIABLE LUBRICANT VANE PUMP

(71) Applicant: PIERBURG PUMP TECHNOLOGY GMBH, Neuss (DE)

(72) Inventor: Massimiliano Lazzerini, San Pietro in Palazzi (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 150 days.

(21) Appl. No.: 16/771,219

(22) PCT Filed: Dec. 13, 2017

(86) PCT No.: PCT/EP2017/082641
§ 371 (c)(1),
(2) Date: Jun. 10, 2020

(87) PCT Pub. No.: WO2019/114949
PCT Pub. Date: Jun. 20, 2019

(65) Prior Publication Data

US 2020/0300092 A1 Sep. 24, 2020

(51) Int. Cl.
*F01C 21/10* (2006.01)
*F04C 2/344* (2006.01)
(Continued)

(52) U.S. Cl.
CPC ..... *F01C 21/10* (2013.01); *F01C 21/0836* (2013.01); *F04C 2/3442* (2013.01);
(Continued)

(58) Field of Classification Search
CPC .... F01C 21/10; F01C 21/0836; F04C 2/3442; F04C 2/00; F04C 14/223; F04C 14/226; F04C 14/26
See application file for complete search history.

(56) References Cited

U.S. PATENT DOCUMENTS 3,134,334 A * 5/1964 Smith ..... F04C 14/223 418/26
5,181,843 A * 1/1993 Hekman ..... F01C 21/0836 418/1

(Continued)

FOREIGN PATENT DOCUMENTS

DE 10 2015 223 452 A1 6/2017
EP 2 735 740 A1 5/2014

(Continued)

OTHER PUBLICATIONS

English translation of EP3973187 by Espacenet, Apr. 21, 2022.*

*Primary Examiner* — Deming Wan
(74) *Attorney, Agent, or Firm* — Norman B. Thot

(57) ABSTRACT

A vane pump for providing a pressurized lubricant includes a static pump housing defining an inlet and an outlet, a shiftable control ring with at least one slide support surface, a pump rotor with rotor vanes which rotate within the control ring, and metal slide support pad(s). The control ring shifts with respect to the pump rotor to vary an eccentricity and to thereby control a volumetric pump performance. The pump housing comprises a static control ring housing body which radially surrounds and supports the control ring, and two static pump housing lids which axially support the control ring housing body and the control ring. The control ring housing body is made of plastic. The metal slide support pad(s) is fixed to the static control ring housing body and, together with the at least one slide support surface, provides a friction bearing for the control ring.

8 Claims, 2 Drawing Sheets

(51) Int. Cl.

| | |
|---|---|
| ***F04C 14/22*** | (2006.01) |
| ***F01C 21/08*** | (2006.01) |
| ***F04C 2/04*** | (2006.01) |
| ***F04C 15/00*** | (2006.01) |

(52) U.S. Cl.
CPC ..... *F04C 14/223* (2013.01); *F04C 2230/90* (2013.01); *F04C 2240/30* (2013.01); *F05C 2201/021* (2013.01); *F05C 2201/0448* (2013.01)

(56) References Cited

U.S. PATENT DOCUMENTS

| | | | | | |
|---|---|---|---|---|---|
| 6,012,900 | A * | 1/2000 | Kennedy | F04D 29/0413 | 415/170.1 |
| 2007/0148011 | A1* | 6/2007 | Schulz-Andres | F01C 21/10 | 417/279 |
| 2007/0231161 | A1* | 10/2007 | Williamson | F04C 14/22 | 417/278 |
| 2010/0135835 | A1* | 6/2010 | Armenio | F04C 2/3442 | 418/27 |
| 2014/0072456 | A1* | 3/2014 | Watanabe | F04B 49/002 | 417/218 |
| 2016/0138592 | A1 | 5/2016 | Moriglia et al. | | |
| 2016/0222963 | A1 | 8/2016 | Cadeddu et al. | | |

FOREIGN PATENT DOCUMENTS

| | | | | |
|---|---|---|---|---|
| EP | 3973187 | * | 3/2022 | F04C 14/22 |
| FR | 2 862 354 | A1 | 5/2005 | |
| WO | WO 2014/198322 | A1 | 12/2014 | |
| WO | WO 2015/036913 | A2 | 3/2015 | |

* cited by examiner

VARIABLE LUBRICANT VANE PUMP

CROSS REFERENCE TO PRIOR APPLICATIONS

This application is a U.S. National Phase application under 35 U.S.C. § 371 of International Application No. PCT/EP2017/082641, filed on Dec. 13, 2017. The International Application was published in English on Jun. 20, 2019 as WO 2019/114949 A1 under PCT Article 21(2).

FIELD

The present invention is directed to a variable lubricant vane pump for providing pressurized lubricant. The present invention is in particular directed to a mechanical variable displacement lubricant vane pump for providing a pressurized lubricant for an internal combustion engine.

BACKGROUND

The variable lubricant vane pump is mechanically driven by the engine, for example, via a gear or belt, and is fluidically coupled to the engine for pumping the pressurized lubricant to and through the engine. The pump outlet pressure or the lubricant gallery pressure in the engine must be controlled and stabilized to a set pressure value.

WO 2014/198322 A1 describes a typical variable lubricant vane pump for providing a pressurized lubricant for an internal combustion engine. The vane pump is provided with a static pump housing, a shiftable control ring, and a rotatable pump rotor comprising several rotor vanes rotating within the shiftable control ring. The control ring is shiftable with respect to the pump rotor to thereby vary the eccentricity of the control ring with respect to the pump rotor for controlling the displacement and, as a result, the volumetric pump performance. The control ring is supported radially shiftably in the static pump housing. The pump housing and the control ring radially define several hydraulic chambers actuating the control ring.

The shiftable control ring is normally made of sintered steel to reduce the friction-related wear caused by the rotor vanes rotating within the control ring. The static pump housing is normally made of aluminum with a low mass density compared to sintered steel to reduce the pump weight. However, aluminum has a higher thermal expansion coefficient compared to sintered steel so that the width of gaps between the aluminum pump housing and the shiftable sintered steel control ring increases with increasing temperature. This can cause leakages of the hydraulic control ring actuation system, thereby reducing the pump's efficiency.

SUMMARY

An aspect of the present invention is to provide a lightweight variable lubricant vane pump with a long lifetime.

In an embodiment, the present invention provides a variable lubricant vane pump for providing a pressurized lubricant. The variable lubricant vane pump includes a static pump housing which defines a pump inlet and a pump outlet, a shiftable control ring comprising at least one slide support surface, a rotatable pump rotor comprising a plurality of rotor vanes which are configured to rotate within the shiftable control ring, and at least one metal slide support pad. The shiftable control ring is configured to be shiftable with respect to the rotatable pump rotor so as to vary an eccentricity of the shiftable control ring with respect to the rotatable pump rotor so as to control a volumetric pump performance. The static pump housing comprises a static control ring housing body which is configured to radially surround and to support the shiftable control ring, and two static pump housing lids which are configured to axially support the static control ring housing body and the shiftable control ring. At least the static control ring housing body is made of a plastic. The at least one metal slide support pad is fixed to the static control ring housing body and, together with the at least one slide support surface, provides a friction bearing for the shiftable control ring.

BRIEF DESCRIPTION OF THE DRAWINGS

The present invention is described in greater detail below on the basis of embodiments and of the drawings in which.

DETAILED DESCRIPTION

Figure 1:
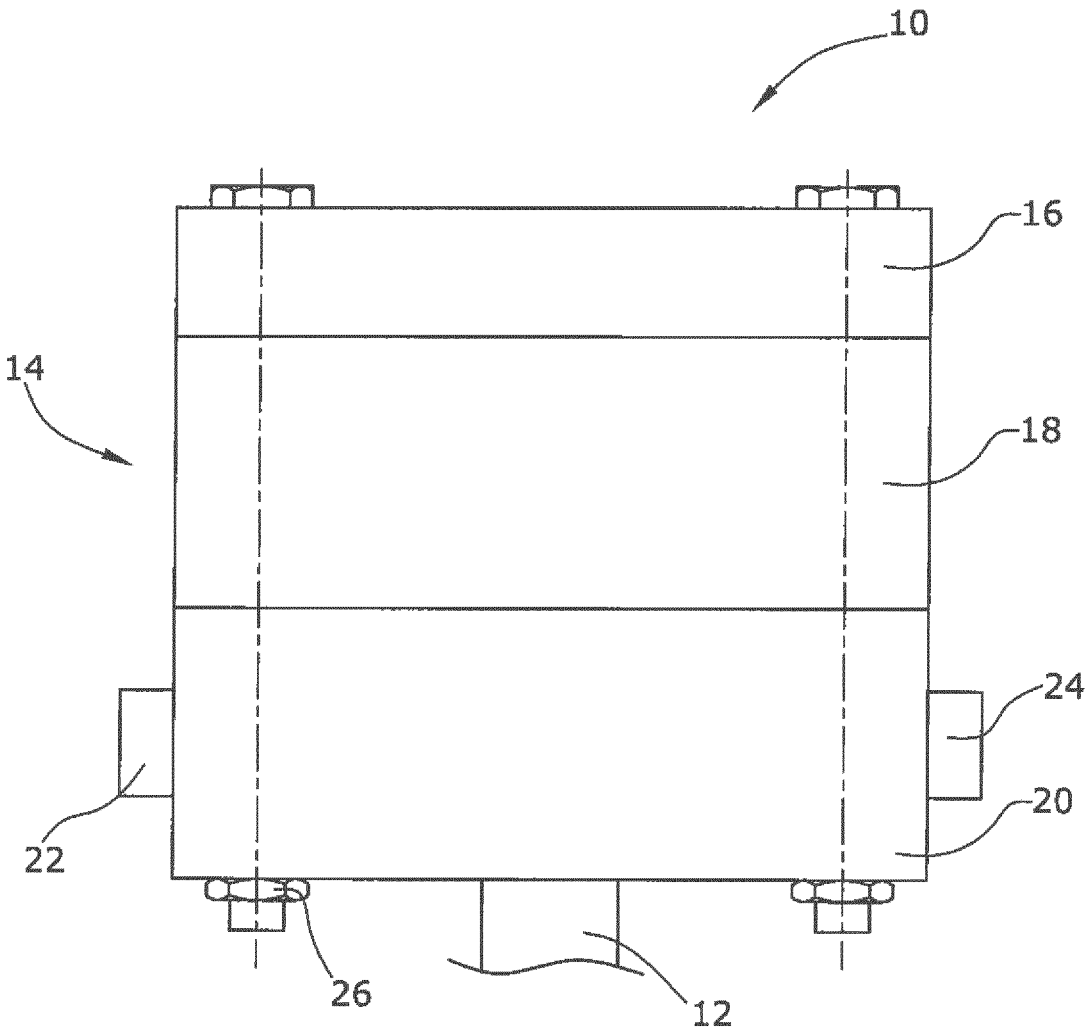
FIG. 1 shows a schematic side view of an embodiment of a variable lubricant vane pump according to the present invention which in particular shows the multi-part pump housing of the vane pump.

The variable lubricant vane pump according to the present invention is provided with a rotatable pump rotor which is positioned within a shiftable control ring. The rotor comprises several rotor vanes which are in contact with the radial inside surface of the control ring and which define several pump chamber compartments. The rotor vanes and, as a result, the pump chamber compartments, rotate within the control ring. The pump rotor axis of rotation is static so that a shifting of the control ring changes the eccentricity of the pump rotor with respect to the surrounding control ring to thereby control the displacement and, as a result, the volumetric performance of the pump.

The variable lubricant vane pump according to the present invention is provided with a static multi-part pump housing defining a pump inlet and a pump outlet. The multi-part pump housing comprises a static control ring housing body radially surrounding and supporting the shiftable control ring, and two static pump housing lids which axially close the control ring housing body and which support the shiftable control ring. The control ring housing body and the two pump housing lids are axially attached to each other, for example, screwed, and fluid-tightly sealed, for example, by circumferential sealings.

The control ring housing body is made of plastic to reduce the weight and the cost of the pump housing and, as a result, of the vane pump. The control ring housing body comprises at least one metal slide support pad which is fixed to the control ring housing body. The shiftable control ring is provided with at least one slide support surface which is supported by the metal slide support pad of the control ring housing body, thereby providing a friction bearing for the shiftable control ring. The metal slide support pad of the plastic control ring housing body significantly reduces the friction-related wear of the control ring surface caused by the movement of the control ring within the control ring housing body.

In an embodiment of the present invention, the shiftable control ring can, for example, be made of metal, for example, of sintered steel, to minimize the friction-related wear of the control ring inside surface caused by the rotating rotor vanes. Sintered steel is very hard-wearing and allows a cost-efficient and durable embodiment of the shiftable control ring.

In an embodiment of the present invention, the shiftable control ring can, for example, be provided to be shiftable exactly linear with respect to the pump rotor axis of rotation. This allows a simple frictional bearing of the control ring within the control ring housing body which does not require any hinges or pivoting bearings.

In an embodiment of the present invention, the static control ring housing body can, for example, be made of plastic with a thermal expansion coefficient substantially equal to the thermal expansion coefficient of the control ring material. The difference of both thermal expansion coefficients is thus less than 5%. As a result, leakages caused by a different thermal expansion of the control ring and of the control ring housing body surrounding and supporting the control ring can be avoided or at least minimized. This provides the vane pump with a good thermal stability.

In an embodiment of the present invention, the static pump housing lids can, for example, be made of metal, for example, of aluminum. This allows a light-weight and also robust realization of the pump housing.

In an embodiment of the present invention, the metal control ring support pads can, for example, only be provided at contact areas located at the pump inlet region of the control ring housing body. Since the vane pump pressurizes the lubricant, the pressure at the pump outlet is higher than the pressure at the pump inlet so that the control ring is normally pushed toward the pump inlet. The friction at the contact areas located at the pump outlet region of the control ring housing is thus very low so that metal control ring support pads are required only at the contact areas located at the pump inlet region of the control ring housing body.

An embodiment of the present invention is described below under reference to the accompanying drawings.

FIG. 1 shows a schematic side view of variable lubricant vane pump 10 as part of a pumping system for supplying an internal combustion engine (which is not shown in the drawings) with a pressurized lubricant. A pump rotor shaft 12 co-rotatably fixed to a pump rotor 34 of the vane pump 10 is mechanically driven by the engine, for example, via a gear wheel or a transmission belt.

The vane pump 10 comprises a static multi-part pump housing 14 with a first static pump housing lid 16, a static control ring housing body 18, and a second static pump housing lid 20 which defines a pump inlet 22 and a pump outlet 24. The two pump housing lids 16, 20 are made of aluminum and the control ring housing body 18 is made of a plastic having a thermal expansion coefficient which is substantially equal to the thermal expansion coefficient of sintered steel. The two pump housing lids 16, 20 and the control ring housing body 18 are axially attached to each other by screws 26 and are fluid-tightly sealed by circumferential sealings.

Figure 2:
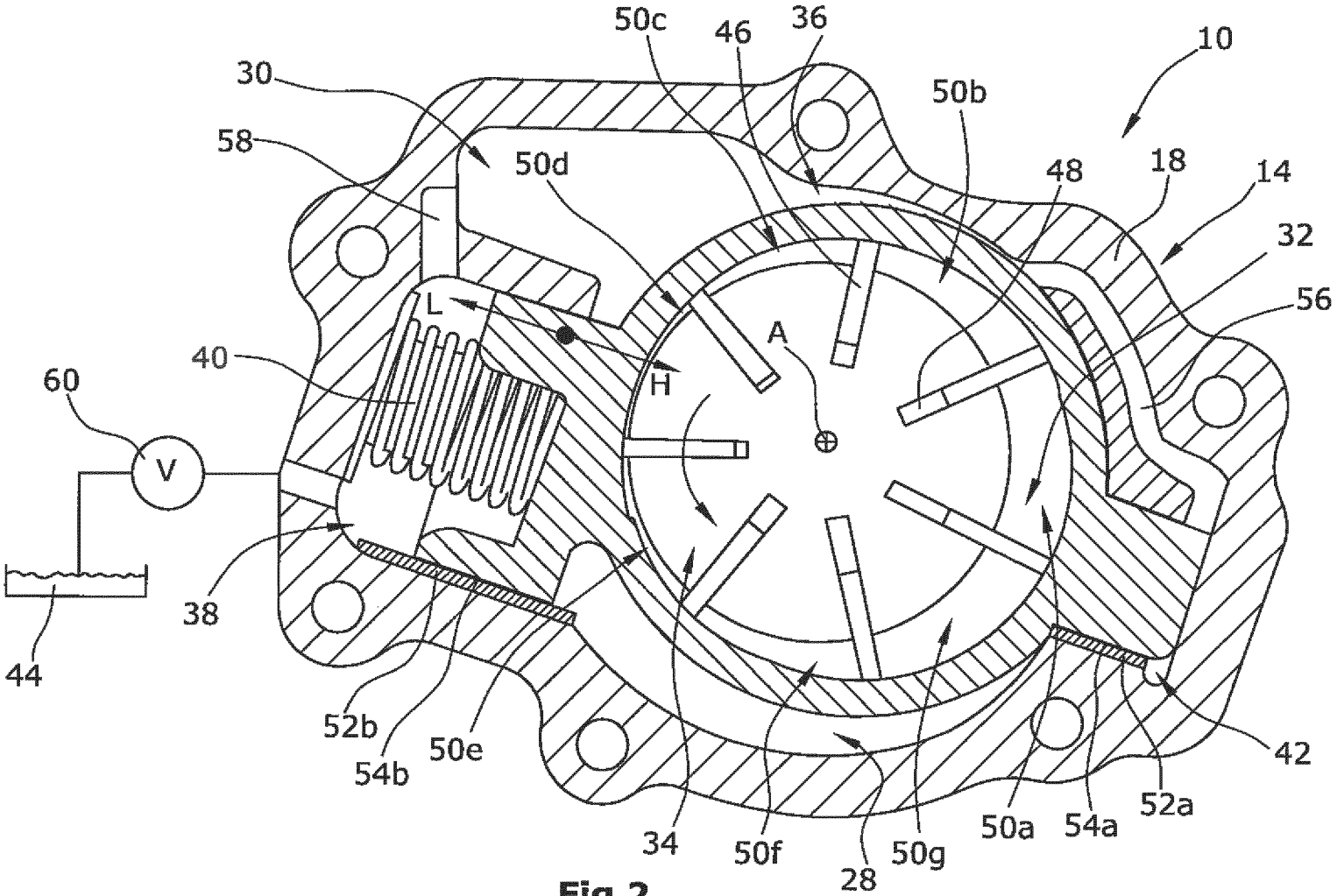
FIG. 2 shows a schematic longitudinal section of the variable lubricant vane pump of FIG. 1.

FIG. 2 shows a schematic longitudinal section of the vane pump 10. The pump housing 14 and, in particular, the control ring housing body 18 radially defines a pump inlet chamber 28, a pump outlet chamber 30, a pumping chamber 32 with a rotatable pump rotor 34 and with a shiftable control ring 36, a spring chamber 38 with a control ring preload spring 40, and defines a pilot chamber 42. The pump inlet chamber 28 is fluidically connected to a lubricant tank 44 via the pump inlet 22 and is provided with atmospheric pressure PA. The pump outlet chamber 30 is pressurized with a pump outlet pressure PO and is fluidically connected with the internal combustion engine via the pump outlet 24.

The pump rotor 34 is radially surrounded by the control ring 36 and rotates in a counterclockwise direction about a static axis of rotation A. The pump rotor 34 is provided with seven rotor vanes 46 which are supported radially slidable within corresponding vane slits 48. The two pump housing lids 16, 20, the control ring 36, and the rotor vanes 46 define seven pumping chamber compartments 50*a* 50*g*. The rotor vanes 46 and, as a result, the pumping chamber compartments 50*a*-50*g* rotate within the control ring 36. The control ring 36 is made of hard-wearing sintered steel so that the wear of the control ring 36 inside surface caused by the rotating rotor vanes 46 is minimized.

The control ring 36 is shiftable exactly linear with respect to the pump rotor 34 and the pump housing 14. The volumetric pump performance of the pump 10 can be controlled by moving the control ring 36 and thereby varying the eccentricity of the pump rotor 34 with respect to the surrounding control ring 36.

The control ring 36 is preloaded by the control ring preload spring 40 pushing the control ring 36 into a high-eccentricity direction H. As a result, if no other forces in the shifting direction of the control ring 36 are effective with respect to the control ring 36, the control ring 36 is pushed into the maximum-eccentricity position providing the maximum volumetric pump performance.

The control ring 36 is loaded in the opposing low-eccentricity direction L by the pressure of the pilot chamber 42. The pilot chamber 42 is fluidically connected with the pump outlet chamber 30 by a pilot chamber channel 56 and, as a result, is pressurized with the pump outlet pressure PO.

The control ring 36 is loaded in the high-eccentricity direction H by the pressure of the spring chamber 38. The spring chamber 38 is fluidically connected with the pump outlet chamber 30 via a spring chamber channel 58 and is fluidically connected with a lubricant tank 44 via a control valve 60. The lubricant tank 44 is provided with atmospheric pressure PA. As a result, the control valve 60 allows controlling the spring chamber 38 pressure in the pressure range between the atmospheric pressure PA and the pump outlet pressure PO.

The radial position of the control ring 36 depends on the ratio of the spring chamber 38 pressure to the pilot chamber 42 pressure and, as a result, can be controlled via the control valve 60. Since the control ring 36 and the control ring housing body 18 have substantially equal thermal expansion coefficients, leakages of the spring chamber 38 or of the pilot chamber 42 caused by different thermal expansions of the control ring 36 and of the surrounding and supporting control ring housing body 18 are avoided or at least minimized. This allows a temperature-stable control of the pump performance and, as a result, a temperature-stable pump efficiency.

The control ring 36 is axially supported by the two pump housing lids 16, 20 and is radially supported by two metal slide support pads 52*a*, 52*b* being attached to the control ring housing body 18. The control ring is radially loaded toward the pump inlet chamber 28 via the pressure difference between the pump outlet chamber 30 and the pump inlet chamber 28. The metal slide support pads 52*a*, 52*b* are thereby located at the pump inlet 22 region of the control ring housing body 18. The metal slide support pads 52*a*, 52*b* support the control ring 36 via corresponding slide support surfaces 54*a*, 54*b* being provided at the control ring 36 outside surface.

The metal slide support pads 52*a*, 52*b* and the slide support surfaces 54*a*, 54*b* provide a low-friction friction bearing for the control ring 36. The friction-related wear of the control ring 36 outside surface caused by the control ring 36 movement within the control ring housing body 18 is thereby minimized.

The present invention is not limited to embodiments described herein; reference should be had to the appended claims.

LIST OF REFERENCE NUMERALS

10 variable lubricant vane pump
12 pump rotor shaft
14 static multi-part pump housing
16 first static pump housing lid
18 static control ring housing body
20 second static pump housing lid
22 pump inlet
24 pump outlet
26 screws
28 pump inlet chamber
30 pump outlet chamber
32 pumping chamber
34 rotatable pump rotor
36 shiftable control ring
38 spring chamber
40 control ring preload spring
42 pilot chamber
44 lubricant tank
46 rotor vanes
48 vane slits
50*a*-50*g* pumping chamber compartments
52*a*, 52*b* metal slide support pads
54*a*, 54*b* slide support surfaces
56 pilot chamber channel
58 spring chamber channel
60 control valve
A static axis of rotation
H high-eccentricity direction
L low-eccentricity direction

What is claimed is:

1. A variable lubricant vane pump for providing a pressurized lubricant, the variable lubricant vane pump comprising:

a static pump housing which defines a pump inlet and a pump outlet;

a shiftable control ring comprising at least one slide support surface;

a rotatable pump rotor comprising a plurality of rotor vanes which are configured to rotate within the shiftable control ring; and at least one metal slide support pad, wherein, the shiftable control ring is configured to be shiftable with respect to the rotatable pump rotor so as to vary an eccentricity of the shiftable control ring with respect to the rotatable pump rotor so as to control a volumetric pump performance, the static pump housing comprises, a static control ring housing body which is configured to radially surround and to support the shiftable control ring, and two static pump housing lids which are configured to axially support the static control ring housing body and the shiftable control ring, at least the static control ring housing body is made of a plastic, and the at least one metal slide support pad is fixed to the static control ring housing body and, together with the at least one slide support surface, provides a friction bearing for the shiftable control ring.

2. The variable lubricant vane pump as recited in claim 1, wherein the shiftable control ring is made of a metal.

3. The variable lubricant vane pump as recited in claim 2, wherein the metal is a sintered steel.

4. The variable lubricant vane pump as recited in claim 1, wherein the shiftable control ring is configured to be shiftable exactly linear with respect to the rotatable pump rotor.

5. The variable lubricant vane pump as recited in claim 1, wherein, the shiftable control ring is made of a material, and the plastic of the static control ring housing body has a thermal expansion coefficient which is substantially equal to a thermal expansion coefficient of the material of the shiftable control ring.

6. The variable lubricant vane pump as recited in claim 1, wherein the two static pump housing lids of the static pump housing are made of a metal.

7. The variable lubricant vane pump as recited in claim 6, wherein the metal is aluminum.

8. The variable lubricant vane pump as recited in claim 1, wherein the at least one metal slide support pad is only provided at a contact area which is located at a region of the pump inlet of the static control ring housing body.

* * * * *